US008100510B2

(12) United States Patent
Carlson et al.

(10) Patent No.: US 8,100,510 B2
(45) Date of Patent: Jan. 24, 2012

(54) INKJET PRINTHEAD SYSTEM AND METHOD USING LASER-BASED HEATING

(75) Inventors: Gregory Frank Carlson, Vancouver, WA (US); Ronald Gregory Paul, Vancouver, WA (US); Steven Michael Goss, Corvallis, OR (US); Todd Alan McClelland, Corvallis, OR (US)

(73) Assignee: Marvell International Technology Ltd. (BM)

( * ) Notice: Subject to any disclaimer, the term of this patent is extended or adjusted under 35 U.S.C. 154(b) by 0 days.

(21) Appl. No.: 12/915,770

(22) Filed: Oct. 29, 2010

(65) Prior Publication Data

US 2011/0043571 A1 Feb. 24, 2011

Related U.S. Application Data

(62) Division of application No. 11/266,507, filed on Nov. 3, 2005, now Pat. No. 7,837,302.

(51) Int. Cl.
*B41J 2/14* (2006.01)
*B41J 2/05* (2006.01)

(52) U.S. Cl. ..... 347/51; 347/67

(58) Field of Classification Search ..... 347/42, 347/51–53, 67

See application file for complete search history.

(56) References Cited

U.S. PATENT DOCUMENTS

| | | | | |
|---|---|---|---|---|
| 4,975,626 | A | 12/1990 | Yagi et al. | |
| 5,650,811 | A * | 7/1997 | Seccombe et al. | 347/85 |
| 5,713,673 | A | 2/1998 | Nemoto et al. | |
| 6,091,439 | A * | 7/2000 | Nakatsuka et al. | 347/254 |
| 7,287,833 | B2 | 10/2007 | Howard | |
| 2002/0001027 | A1 * | 1/2002 | Sugioka et al. | 347/104 |
| 2004/0032459 | A1 | 2/2004 | Te | |
| 2004/0201646 | A1 | 10/2004 | Sohn et al. | |
| 2007/0097180 | A1 | 5/2007 | Carlson et al. | |

FOREIGN PATENT DOCUMENTS

| | | |
|---|---|---|
| EP | 0 051 468 A2 | 5/1982 |
| JP | 60023049 A | 2/1985 |

OTHER PUBLICATIONS

Ink-Jet Printer: Definition and Much More from Answers.com, [online], [retrieved on Jul. 2, 2007], Retrieved from: http://www.answers.com/topic/ink-jet-printer?cat=bix-fin.

Tseng, Fan-Gang et al., A Novel Microinjector With Virtual Chamber Neck, 11$^{th}$ IEEE workshop on MEMS, Heidelberg, Germany, Jan. 25-29, 1998.

Translation of Japanese Patent No. JP 60023049 A, dated Feb. 5, 1985.

* cited by examiner

*Primary Examiner* — Geoffrey Mruk

(57) ABSTRACT

An inkjet nozzle array includes a plurality of nozzles. Each nozzle includes a chamber having an input aperture adapted to receive ink into the chamber and an output aperture through which ink is ejected from the chamber. Each chamber further includes a window adapted to receive electromagnetic radiation and operable to heat ink in the chamber responsive to the electromagnetic radiation and eject an ink droplet through the output aperture.

18 Claims, 5 Drawing Sheets

INKJET PRINTHEAD SYSTEM AND METHOD USING LASER-BASED HEATING

This application is a divisional application of U.S. patent application Ser. No. 11/266,507, filed Nov. 3, 2005 which is now U.S. Pat. No. 7,837,302.

BACKGROUND OF THE INVENTION

Inkjet printers have become increasingly popular for use in printing high quality text and image documents. In an inkjet printer, a printhead 100 includes an array of nozzles 102 as shown in FIG. 1. In operation, the printhead 100 moves across a surface of a printable medium (not shown) such as a sheet of paper with the array of nozzles 102 adjacent the surface of the paper. While the printhead 100 moves across the surface, control circuitry (not shown) controls each of the nozzles 102 to selectively spray or eject tiny droplets of ink onto the surface of the paper. The tiny droplets of the ink are selectively ejected from the nozzles 102 and deposited on the surface of the paper to form the desired text or images on the paper.

FIG. 2 is a simplified cross-sectional view of a single one of the nozzles 102 of FIG. 1. The nozzle 102 includes walls 200 and 202 that form a chamber 204 having an input aperture 206 into which ink from an ink reservoir (not shown) is supplied, as indicated by an arrow 208. Each nozzle 102 further includes a heating element or resistor 210 contained in the chamber 204. In operation of the nozzle 102, ink from the ink reservoir first flows into the chamber 204 of the nozzle. Control circuitry (not shown) then applies an electrical current to the resistor 210, causing the resistor to heat up which, in turn, heats up the ink contained in the chamber 204. As the resistor 210 heats up the ink in the chamber 204, a bubble 212 is formed in the ink along a surface of the resistor. The bubble 212 grows larger as the resistor 210 continues heating the ink, until at some point the bubble becomes so large that a tiny droplet of ink is sprayed or ejected from an output aperture 214 of the nozzle 102, as indicated by an air row 216.

FIG. 2 shows a surface 218 of a droplet that is being formed as ink is partially forced through the output aperture 214 in response to the growing bubble 212, with the droplet being ejected from the nozzle once the bubble reaches a sufficient size. In place of the resistor 210, some conventional nozzles 102 include a piezoelectric element. The piezoelectric element changes shape in response to an applied electrical signal to thereby apply pressure to the ink in the chamber 204 and eject a droplet of ink from the chamber via the output aperture 214.

From the above description of the printhead 100 and array of nozzles 102, it is seen that each nozzle must include as individual resistor 210 (or piezoelectric element) to spray or eject ink droplets from the nozzle. As a result, suitable conductive traces (not shown) must be routed to each nozzle 102 in the array and coupled to control circuitry (not shown) that controls the application of an electrical current to each resistor 210 via these conductive traces. The array may include hundreds or even thousands of nozzles 102 and the corresponding number of required conductive traces must of course be formed.

The array of nozzles 102 and required conductive traces are typically formed using conventional processing techniques that are utilized in manufacturing semiconductor integrated circuits. For example, various layers of silicon, oxide, and other materials may be formed, etched, and otherwise processed on a silicon substrate to form the chambers 204, chamber walls 200, 202, input aperture 206, output aperture 218, resistor 210, and any other components required for forming the nozzles 102. The output apertures 218, for example, are typically laser drilled holes that are formed in much the same way as through-holes or vias are formed during the manufacture of integrated circuits. These overall processing steps, including in particular the laser-drilled holes that form the output apertures 214 and the resistors 210 and associated conductive traces, make the formation of the conventional printhead 100 relatively expensive.

There is a need to simplify the construction of and lower the cost of inkjet printheads.

SUMMARY OF THE INVENTION

According to one aspect of the present invention, an inkjet nozzle array includes a plurality of nozzles. Each nozzle includes a chamber having an input aperture adapted to receive ink into the chamber and an output aperture through which ink is ejected from the chamber. Each chamber further includes a window adapted to receive electromagnetic radiation and operable to heat ink in the chamber responsive to the electromagnetic radiation and eject an ink droplet through the output aperture.

DETAILED DESCRIPTION OF PREFERRED EMBODIMENTS

Figure 1:
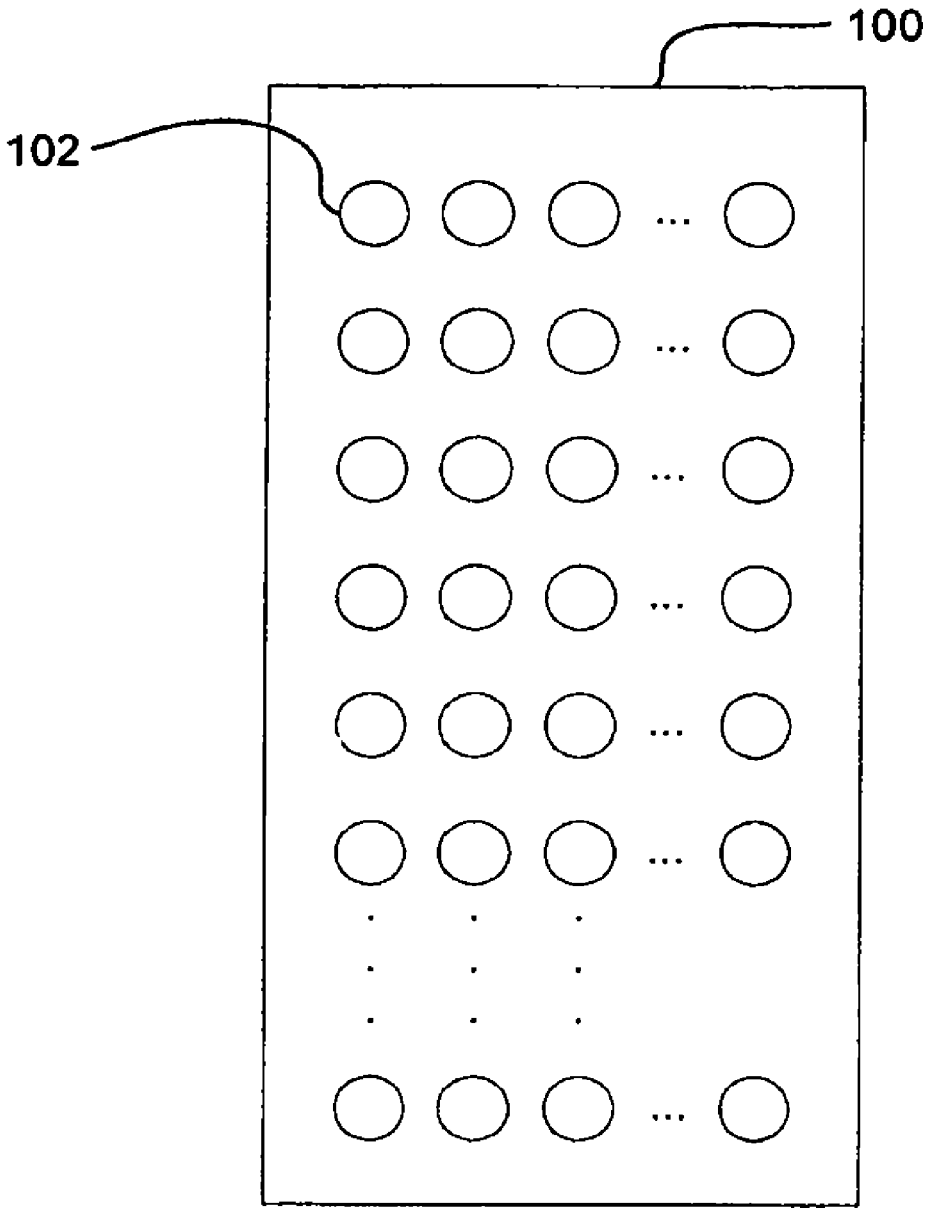
Figure 1 (Background Art)
FIG. 1 is a simplified view of an array of nozzles contained on a conventional inkjet printhead.
Figure 3:
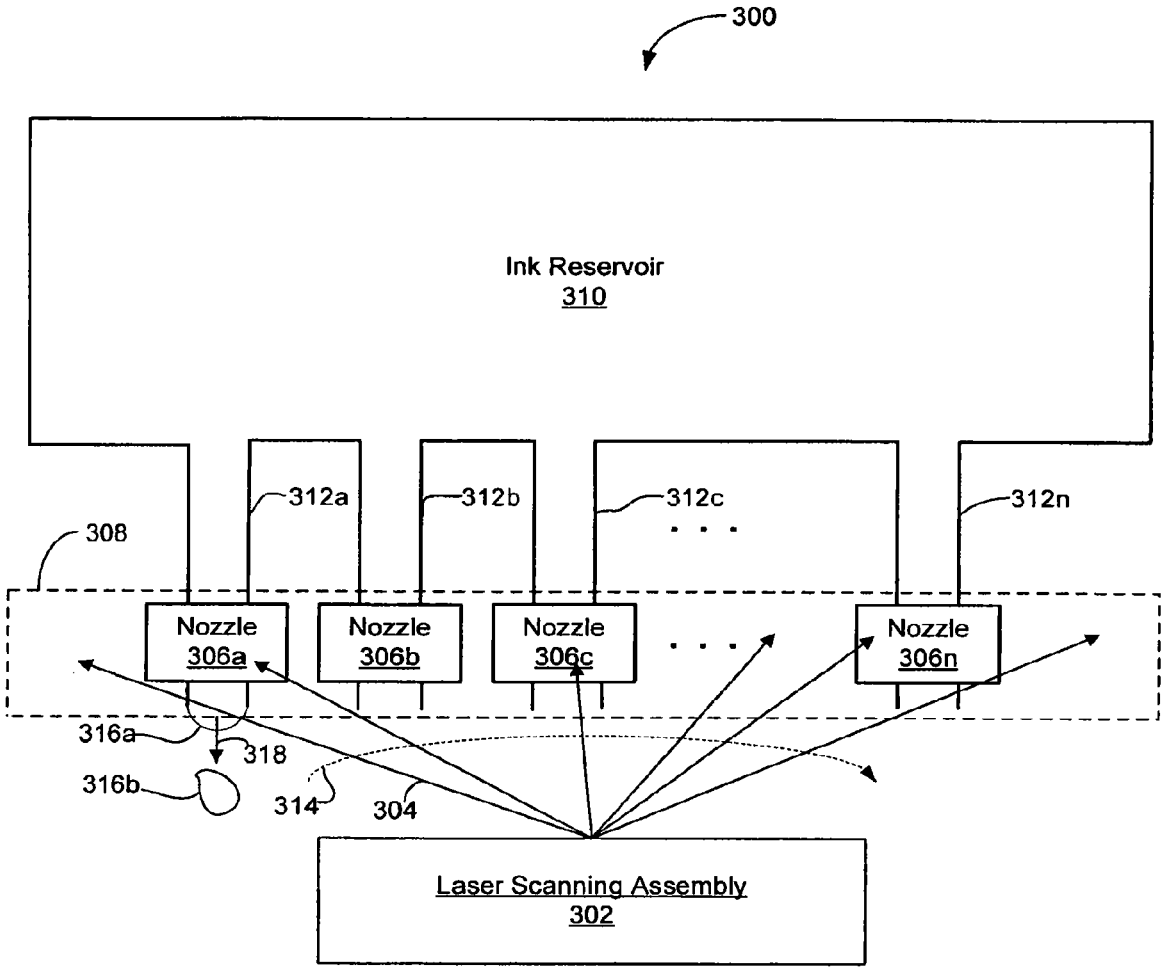
FIG. 3 is a functional diagram of an inkjet printhead including a nozzle array having a number of individual nozzles that are scanned by a laser beam to heat the ink in the nozzles according to one embodiment of the present invention.

FIG. 3 is a functional diagram of an inkjet printhead 300 including a laser scanning assembly 302 that scans a laser beam 304 across of number of nozzles 306*a-n* in a nozzle array 308 to heat the ink in selected ones of the nozzles according to one embodiment of the present invention. In response to the laser beam 304 heating the ink in selected ones of the nozzles 306*a-n*, the nozzles eject ink droplets to thereby print desired text and images on a printable medium (not shown) such as paper, as will be described in more detail below. The printhead 300 includes a single relatively expensive component, namely the laser scanning assembly 302, which functions to heat the ink in all nozzles 306*a-n* of the array 308. This may result in the overall cost of the printhead 300 being less than the cost of the conventional printhead 100 (FIG. 1) requiring an individual heating element, namely the resistor 210, for each inkjet nozzle 102. Moreover, no electrical signals must be routed to the nozzles 306*a-n* in the printhead 300, further simplifying the overall construction of the nozzle array 308 and enabling the array to be formed from alternative materials, both of which may also help reduce the overall cost of the printhead 300 compared to the conventional printhead 100.

In the following description, certain details are set forth in conjunction with the described embodiments of the present invention to provide a sufficient understanding of the invention. One skilled in the art will appreciate, however, that the invention may be practiced without these particular details. Furthermore, one skilled in the art will appreciate that the example embodiments described below do not limit the scope of the present invention, and will also understand that various modifications, equivalents, and combinations of the disclosed embodiments and components of such embodiments are within the scope of the present invention. Embodiments including fewer than all the components of any of the respective described embodiments may also be within the scope of the present invention although not expressly described in detail below. Finally, the operation of well known components and/or processes has not been shown or described in detail below to avoid unnecessarily obscuring the present invention. Also note that when referring generally to any one of nozzles 306*a-n* the letter designation may be omitted and only when referring to a specific one of the nozzles 306*a-n* will the letter designation be included.

The printhead 300 further includes an ink reservoir 310 that stores ink and supplies this ink to the nozzles 304*a-n* through a number of liquid feed tubes 312*a-n*. Each liquid feed tube 312*a-n* supplies ink to a corresponding nozzle 306*a-n* in the array 308. In operation, of the printhead 300, ink initially flows through the feed tubes 312*a-n* and into the nozzles 306*a-n*. The scan assembly 302 scans the laser beam 304 across the nozzles 306*a-n* from left to right as indicated by an arrow 314. As the assembly 302 scans the laser beam 304 from left to right across the nozzles 306*a-n*, the assembly modulates the intensity of the laser beam, turning the beam ON when the beam is scanning selected ones of the nozzles and turning the beam OFF when the beam is scanning non-selected ones of the nozzles. In the selected nozzles 306*a-n*, the ink is heated by the laser beam 304. In response to being heated, each selected nozzle 306*a-n* ejects a corresponding ink droplet, as illustrated for the nozzle 306*a* in FIG. 3. For the nozzle 306*a*, an ink droplet is shown partially ejected from the nozzle as a droplet 316*a* and fully ejected as a droplet 3166. The droplet 31612 is ejected from the nozzle 306*a* in a direction indicated by an arrow 318.

As the laser assembly 302 modulates the laser beam 304 as a function of the text and/or images being printed on a printable medium (not shown) adjacent the nozzles. For a selected nozzle 306, meaning a nozzle that is to eject an ink droplet 318 as required for the text and/or images being printed, the assembly turns the beam ON as the beam traverses that nozzle during the left-to-right scan of the beam. If the nozzle 306*a* is a selected nozzle and nozzle 306*b* a non-selected nozzle, for example, as the assembly 302 begins scanning the beam from left-to-right as indicated by arrow 314, the beam initially turns the beam ON for a first short duration. This first short duration corresponds to the time the beam is incident on the nozzle 306*a*. After this short duration, the assembly 302 turns the beam 304 OFF for a second short duration corresponding to the time the beam is incident upon the nozzle 306*b*. The assembly 302 continues operating in this manner as the beam 304 traverses all the nozzles 306*a-n*, modulating the beam by turning the beam ON and OFF as required based upon the text and/or images being printed. Assuming the assembly 302 scans the laser beam 304 at a constant velocity, then the duration for which the assembly turns the beam ON or OFF for each beam is the same.

In another embodiment, the laser scanning assembly 302 could generate a plurality of laser beams 304, with each beam scanning an associated group of nozzles 306 in the array 308. For example, in one embodiment the array 308 includes several rows of nozzles 306 and the assembly 302 generates a separate laser beam 304 to scan the nozzles in each row. In another embodiment, the assembly 302 generates a plurality of laser beams 304, each scanning a group of nozzles 306 in the single row of nozzles 306 as shown in FIG. 3. The laser scanning assembly 302 generates n laser beams 304, one for each of the n total nozzles 306 in the array 308, in yet another embodiment. Numerous additional embodiments including variations in the numbers of rows of nozzles 306 in the array 308 and the number of laser beam 304 generated by scanning assembly 302, as will be appreciated by those skilled in the art.

In a further embodiment, the laser scanning assembly 302 varies the energy of the laser beam 304 as the beam scans across the nozzles 306 to control or vary the size ink droplets ejected from the nozzles. One skilled in the art will appreciate that the size of ink droplets ejected from the nozzles 306 that operate in the previously described manner is a function of the energy of the laser beam 304 applied to the nozzles, and thus this operation will not be described in more detail. To control the energy of the laser beam 304, the scanning assembly 302 can adjust various parameters of the laser beam. For example, the scanning assembly 302 can vary the frequency of the laser beam 304, with the frequency determining the energy applied to each of the nozzles 306 and in this way controlling the size of ink droplets ejected from the nozzles. The duration that the laser beam 304 is applied to respective nozzles 306 may alternatively be varied to control the energy applied to the nozzles and thus the size of ejected ink droplets. The laser scanning assembly 302 can also adjust the intensity or power of the laser beam 304 to thereby control the amount of energy applied to the nozzles 306, or can modulate the laser beam in different ways to control the energy delivered to respective nozzles 306. Combinations of these approaches can also be used during operation of the laser scanning assembly 302. Also, these approaches may be used on some nozzles 306 but not on other nozzles to eject different size ink droplets from different ones of the nozzles.

Figure 4:
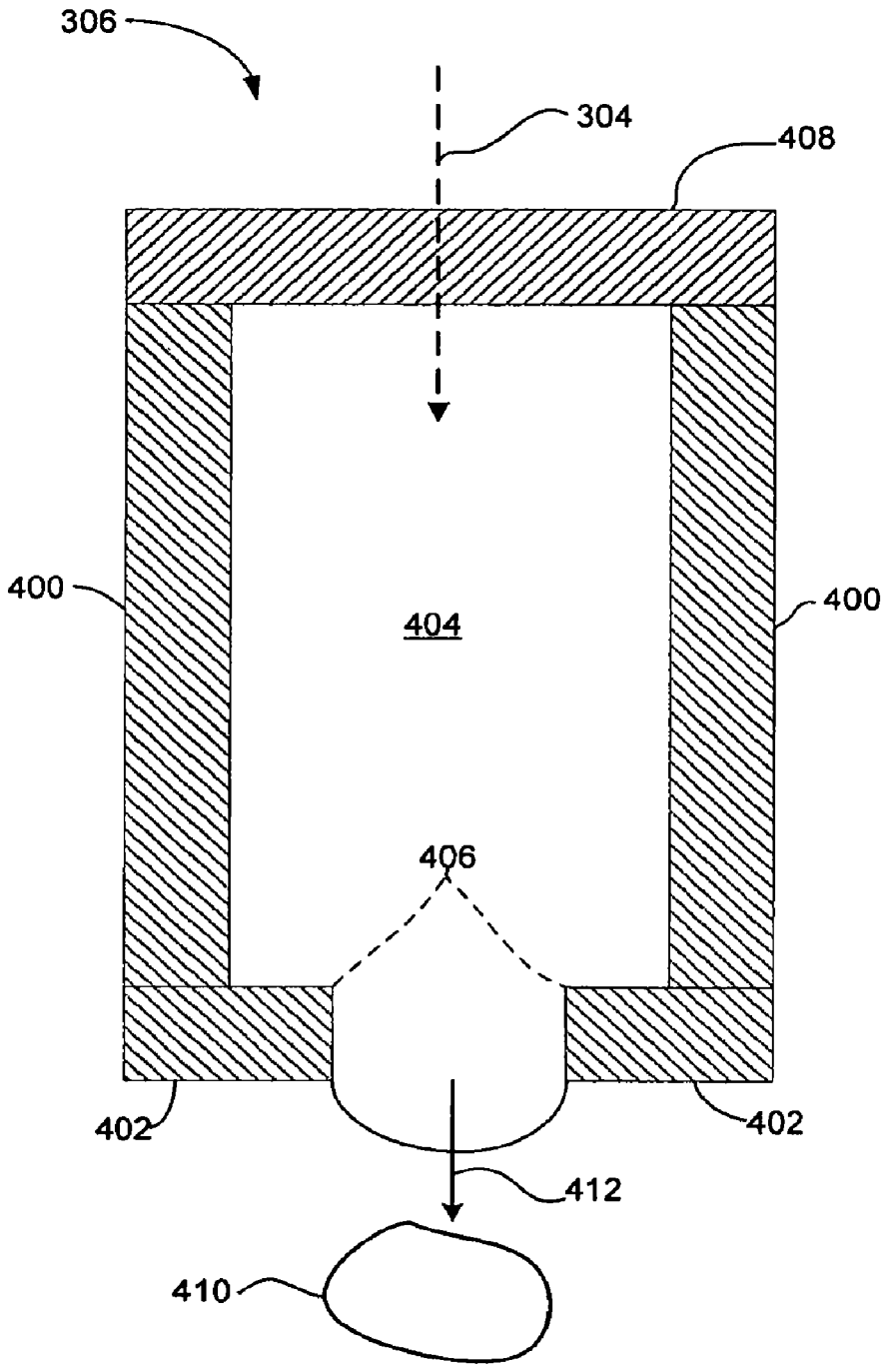
FIG. 4 is a functional cross-sectional view of one embodiment of an individual nozzle in the nozzle array of FIG. 3.

FIG. 4 is a functional cross-sectional view of one embodiment of an individual one of the nozzles 306 in the nozzle array 308 of FIG. 3. The nozzle 306 includes sidewalls designated 400 and a bottom wall 402 that collectively form a chamber 404 that holds the ink contained in the nozzle. The bottom wall 402 includes an output aperture 406 through which ink is ejected from the chamber. A window 408 defines a top of the chamber 404 and it is through the window that the laser beam 304 heats the ink in the chamber 404 to eject an ink droplet from the chamber. In one embodiment, the window 408 is formed from a material that allows the laser beam 304 to propagate through the window to heat the ink in the chamber 404. For a laser beam 304 of a given wavelength, the window 408 is thus formed of a suitable material that is substantially transparent to the laser beam.

In another embodiment, the window 408 is formed from a material that absorbs the incident laser beam 304. In response to the absorbed laser beam 304, the window 408 heats up and this heat is transferred to the ink in the chamber 404 to thereby heat the ink. In this embodiment, the window 408 is of course formed from a suitable material to absorb the laser beam 304 of a given wavelength. When the ink in the chamber 404 is heated in either of these embodiments, an ink droplet 410 is ejected from the chamber in a direction indicated by an arrow 412. After an ink droplet 410 is ejected from the chamber 404, new ink flows into the chamber via a feed tube (not shown) such as the feed tubes 312 described in FIG. 3.

Figure 2:
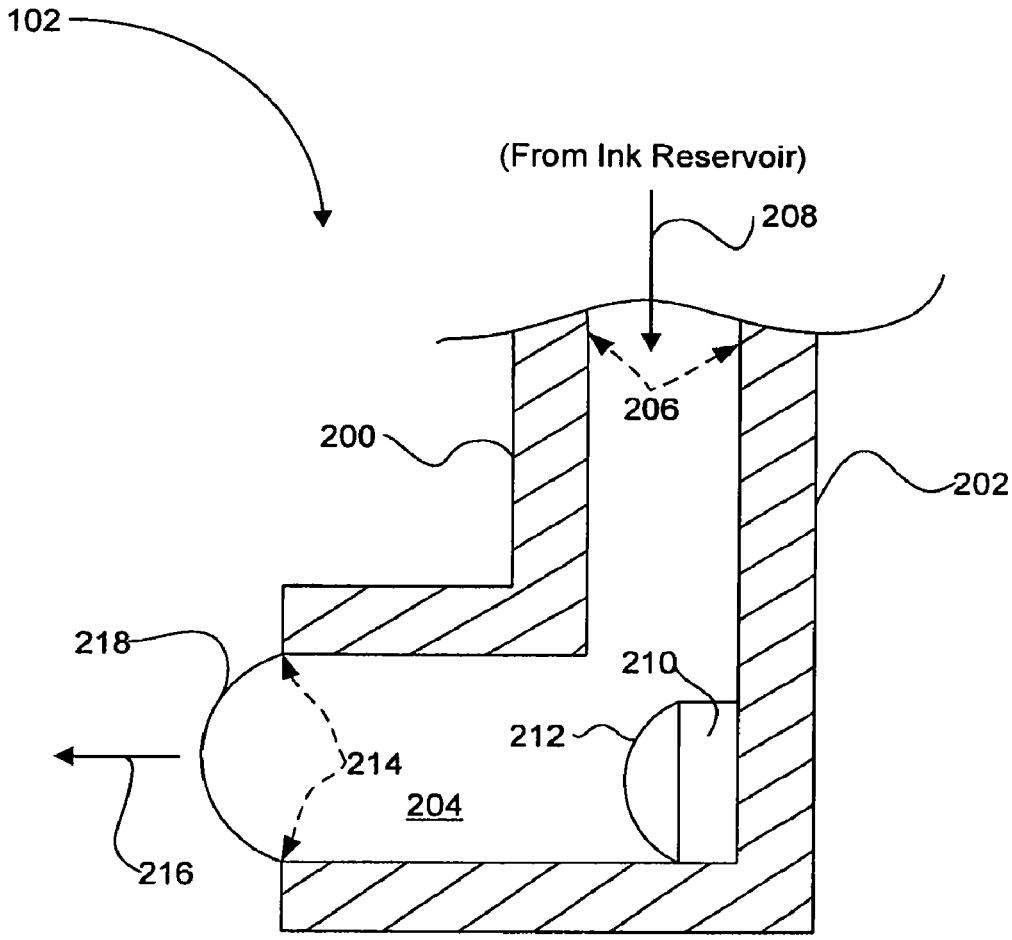
Figure 2 (Background Art)
FIG. 2 is a simplified cross-sectional view of a single one of the nozzles of FIG. 1.

Note that FIG. 4 is merely a functional embodiment of the nozzles 306 and that the actual physical construction of the nozzles may vary widely. Such physical embodiments of the nozzles 306 are within the scope of the present invention. Also note that no electrical signals must be routed to the nozzles 306 in the embodiments of FIGS. 3 and 4, in contrast to the situation for the conventional printhead 100 of FIG. 1. This simplifies the overall construction of the nozzle array 308 and enables the array to be formed from alternative materials such as glass or plastic. As previously mentioned, the combination of simplified construction and alternative materials both may reduce the overall cost of the printhead 300 compared to the conventional printhead 100. The printhead 300 also need include only a single relatively expensive component in the form of the laser scanning assembly 302, in contrast to the individual heating resistors 210 contained in each conventional nozzle 102 of FIG. 2.

Figure 5:
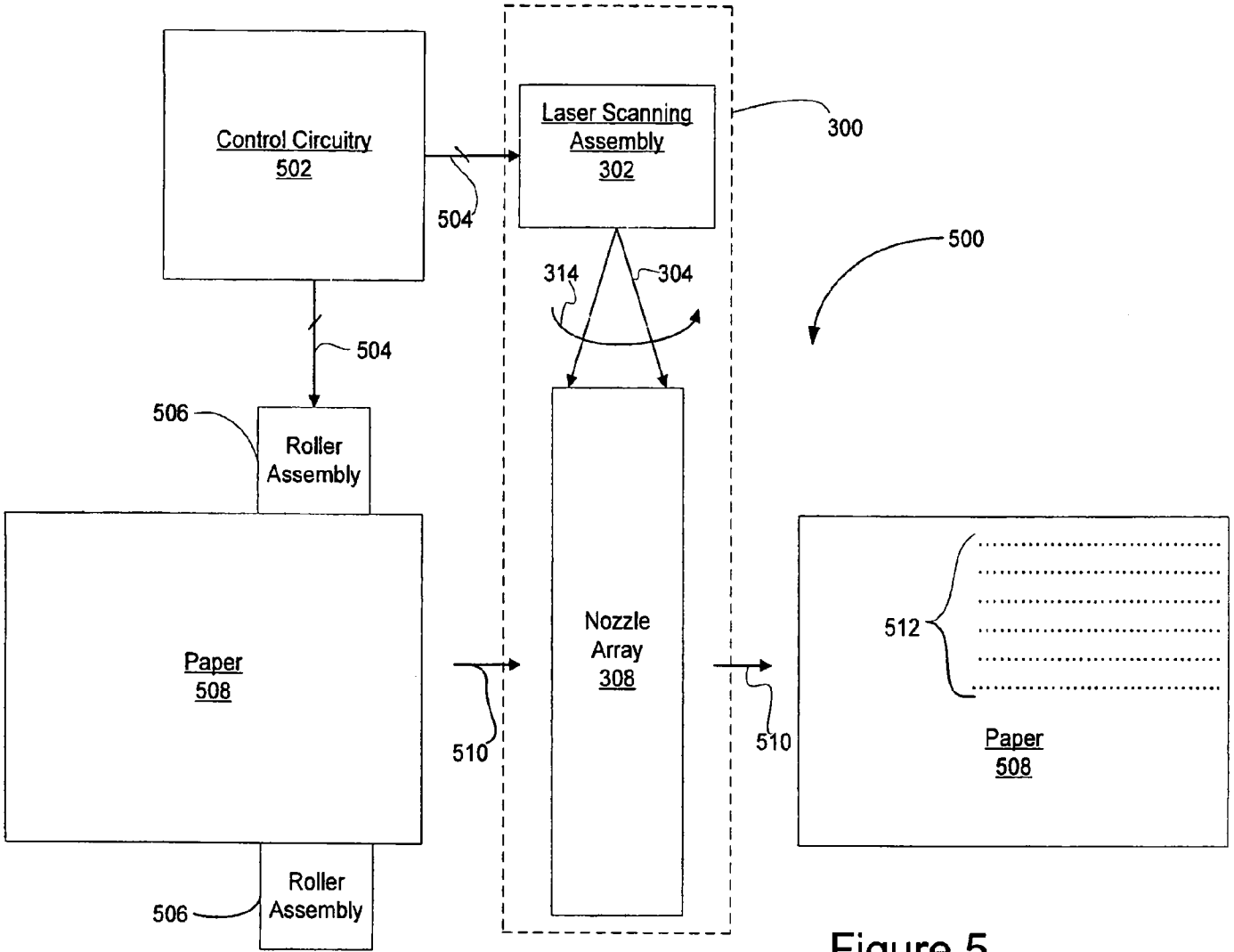
FIG. 5 is a functional block diagram of an inkjet printer including the printhead of FIG. 3 according to one embodiment of the present invention.

FIG. 5 is a functional block diagram of an inkjet printer 500 including the printhead 300 of FIG. 3 according to one embodiment of the present invention. Only the laser scanning assembly 302 scanning the laser beam 304 across the nozzle array 308 in a direction indicated by the arrow 314 is shown in FIG. 5. Control circuitry 502 generates a plurality of control signals 504 that are applied to control the laser scanning assembly 302 and to control the overall operation of the printer 500. In response to the control signals 504 applied to the laser scanning assembly 302, the assembly controls the scanning and modulation of the laser beam 304. The control circuitry 502 applies additional control signals 504 to control various mechanical components in the printer 500, such as a roller assembly 506 that controls the movement of sheets of paper 508 or other suitable printable medium past the nozzle array 308. The roller assembly 506 moves the sheets of paper 508 past the nozzle array 308 from left to right as indicated by arrows 510 in the example embodiment of FIG. 5.

In operation, the control circuitry 502 receives the data to be printed, typically from a computer (not shown) coupled to the printer 500. The control circuitry 502 develops the control signals 504 using the received data, and applies these control signals to the laser scanning assembly 302. The control circuitry 502 also develops the control signals 504 to control the roller assembly 506 and other mechanical component in the printer 500. In response to the control signals 504, the roller assembly 506 positions a sheet of paper 508 adjacent the nozzle array 308 and begins moving the sheet from left-to-right past the array as indicated by the arrows 510. At the same time, the laser scanning assembly 302 scans the laser beam 304 across the nozzle array 308 to cause the nozzles 306 (FIG. 3) to eject ink droplets 316*b* onto the sheet of paper 508. As the assembly 302 scans the beam 304 across the nozzle array 308, the assembly modulates the beam ON and OFF responsive to the control signals from the control circuitry 502. In this way, ink is ejected from selected nozzles 306 (FIG. 3) and not ejected from non-selected nozzles 306 to print the desired text and/or images on the sheet of paper 508. The sheet of paper 508 to the right of the nozzle array 308 represents a sheet on which desired text and/or images have been printed, as indicated by dots 512 in the upper right hand portion of the sheet.

Also note that while the scanning assembly 302 is described as generating the laser beam 304, the assembly can generate any suitable beam of electromagnetic radiation to heat the ink in the nozzles 306. Thus, for example, the assembly 302 could generate a suitable beam of microwave radiation for the beam 304 or could use light emitting diodes (LEDs) or other suitable devices to generate the beam instead of a laser. The scanning assembly 302 may also use any suitable means for scanning the beam 304 across the nozzles 306 in the array 308, such as a rotating mirror as is common in conventional laser printers or an oscillating mirror such as a suitable microelectromechanical systems (MEMS) device. Although the term "inkjet" is used to describe the printer and printhead in the above described embodiments of the present invention, this term is used generally to refer to any type of printer or printhead that ejects ink droplets in response to ink being heated or otherwise ejected responsive to application of electromagnetic radiation.

Even though various embodiments and advantages of the present invention have been set forth in the foregoing description, the above disclosure is illustrative only, and changes may be made in detail and yet remain within the broad principles of the present invention. Moreover, the functions performed by components in the embodiments of FIGS. 3 and 5 can be combined to be performed by fewer elements, separated and performed by more elements, or combined into different functional blocks in other embodiments of the present invention, as will appreciated by those skilled in the art. Also, some of the components described above may be implemented using either digital or analog circuitry, or a combination of both, and also, where appropriate, may be realized through software executing on suitable processing circuitry. Therefore, the present invention is to be limited only by the appended claims.

The invention claimed is:

1. A method comprising:

transporting ink from a reservoir to a plurality of nozzles via a plurality of feed tubes wherein each feed tube of the plurality of feed tubes is coupled to one of the plurality of nozzles;

generating a control signal according to image data; and modulating a laser beam based on the control signal and based on a scanning path of the laser beam across the plurality of nozzles, wherein the laser beam heats ink in the plurality of nozzles according to the image data, wherein modulating the laser beam comprises controlling a power or a frequency of the laser beam according to the image data.

2. The method of claim 1, further comprising:

propagating the laser beam through at least one window of the plurality of nozzles to directly heat the ink.

3. The method of claim 1, further comprising:

heating at least one window of the plurality of nozzles with the laser beam, wherein heat is transferred from the at least one window to the ink.

4. The method of claim 1, further comprising:

identifying selected nozzles and non-selected nozzles from the plurality of nozzles; and turning on the laser beam as the laser beam scans the selected nozzles; and turning off the laser beam when the laser beam scans the non-selected nozzles.

5. The method of claim 1, wherein modulating the laser beam comprises controlling a size of an inkjet droplet ejected from one of the plurality of nozzles through an energy of the laser beam determined based on an intensity of a specific location in the image data.

6. The method of claim 1, wherein the reservoir is positioned above the plurality of nozzles.

7. The method of claim 1, wherein the plurality of feed tubes is positioned above the plurality of nozzles.

8. The method of claim 1, further comprising:

firing droplets of ink from the plurality of nozzles to a printable medium below the plurality of nozzles.

9. The method of claim 1, further comprising:

receiving the image data from a host device.

10. The method of claim 1, wherein each of the plurality of feed tubes is coupled to the reservoir.

11. The method of claim 1, wherein each of the plurality of nozzles receives a same color ink from the reservoir.

12. The method of claim 1, wherein at least one of the plurality of feeding tubes is perpendicular to the laser beam or perpendicular to a scanning path of the laser beam.

13. A method of ejecting ink from an array of inkjet nozzles, each inkjet nozzle including a chamber containing ink and having an output aperture through which ink is ejected from the chamber, the method comprising:

receiving ink at the array of inkjet nozzles from a reservoir positioned above the array of inkjet nozzles and through a plurality of feed tubes, wherein each of the plurality of feed tubes is coupled to one of the array of inkjet nozzles;

applying a beam of electromagnetic radiation to heat the ink in at least one of the chambers by controlling a power or a frequency of the beam of electromagnetic radiation according to image data; and ejecting, to a print medium positioned below the array of inkjet nozzles, a droplet of ink from the at least one chamber through the output aperture responsive to the beam of electromagnetic radiation.

14. The method of claim 13, further comprising:

turning the beam of electromagnetic radiation on and off according to image data; and scanning the beam of electromagnetic radiation across the array of inkjet nozzles.

15. The method of claim 13, wherein the beam of electromagnetic radiation includes a plurality of individual beams of electromagnetic radiation, and each individual beam of electromagnetic radiation is associated with one of a plurality of groups of inkjet nozzles making up the array of inkjet nozzles.

16. The method of claim 13, further comprising:

propagating the beam of electromagnetic radiation through at least one window.

17. The method of claim 13, further comprising:

heating at least one window with the beam of electromagnetic radiation; and transferring heat from the at least one window to the ink in the chambers.

18. The method of claim 13, wherein the beam of electromagnetic radiation comprises a microwave beam or a light emitting diode beam.

* * * * *